US011937721B2

(12) United States Patent
Zipser

(10) Patent No.: US 11,937,721 B2
(45) Date of Patent: Mar. 26, 2024

(54) STOCKING APPLICATION DEVICE

(71) Applicant: The Hand Claw LLC, East Lyme, CT (US)

(72) Inventor: Allison Fiscus Zipser, East Lyme, CT (US)

(73) Assignee: Hand Claw LLC, East Lyme, CT (US)

( * ) Notice: Subject to any disclaimer, the term of this patent is extended or adjusted under 35 U.S.C. 154(b) by 0 days.

(21) Appl. No.: 17/813,323

(22) Filed: Jul. 18, 2022

(65) Prior Publication Data

US 2024/0016324 A1 Jan. 18, 2024

(51) Int. Cl.
*A47G 25/90* (2006.01)

(52) U.S. Cl.
CPC ..... *A47G 25/905* (2013.01)

(58) Field of Classification Search
CPC .... A47G 25/905; A47G 25/90; A47G 25/907; A61F 13/00; A61F 13/10; A61F 15/00; A61F 15/005
See application file for complete search history.

(56) References Cited

U.S. PATENT DOCUMENTS 2,038,840 A * 4/1936 Hall ..... A63B 53/14 473/298
2,851,034 A * 9/1958 Hanington ..... A61F 15/005 602/1
2,856,921 A 10/1958 Stoller
5,356,057 A * 10/1994 Vossen ..... A47G 25/907 223/111
5,513,783 A * 5/1996 White ..... B25B 7/02 223/111
6,869,410 B1 * 3/2005 Mosemiller ..... A61F 15/005 602/41
9,801,736 B2 * 10/2017 Horton ..... A61F 2/76
11,253,378 B2 * 2/2022 Stevenson ..... A61F 2/7812
2013/0144201 A1 6/2013 Becker et al.

* cited by examiner

*Primary Examiner* — Ismael Izaguirre
(74) *Attorney, Agent, or Firm* — Briggs IP

(57) ABSTRACT

A stocking application device that facilitates an application of a stocking over a limb of a person. The stocking application device may include a first body portion at a proximate end of the stocking application device. The stocking application device may further include a second body portion attached to the first body portion. The second body portion may include a plurality of U-shaped fingers. Each of the plurality of U-shaped fingers may include a horizontal portion and a pair of vertical portions. Each vertical portion of the pair of vertical portions may include a flared end. The horizontal portions of the plurality of U-shaped fingers may be disposed one over another and attached to the first body portion. Specifically, the horizontal portions may be disposed at a predetermined angle such that vertical portions of the plurality of U-shaped fingers are equally spaced from each other.

19 Claims, 4 Drawing Sheets

STOCKING APPLICATION DEVICE

TECHNICAL FIELD

The present disclosure relates to a stocking application device, and more specifically to a stocking application device that facilitates deployment of bandages or stockinette on a patient's limb.

BACKGROUND

During post-operative or post-injury care on a patient who has endured an injury on a limb, a healthcare worker generally applies cast or splint material on the affected limb to immobilize it for a prolonged period of time. This helps the underlying bones and tissues of the limb to heal.

In most cases, the patient experiences discomfort if the healthcare worker directly applies the cast material on the limb. For example, the patient may experience irritation on the skin of the affected limb if the healthcare worker directly applies the cast or splint material. Hence, as a standard procedure, prior to the application of the cast or splint material, the healthcare worker applies a compression stocking or an elastic stockinette to the limb to relieve the discomfort. Example of such a stocking is a sown or woven elastic sock.

Typically, the healthcare worker applies the compression stocking to fit tightly around the affected limb as an intervening layer between the patient's skin and the surface of the cast or splint material. This ensures that the material of the stocking does not "bunch" under the cast and cause discomfort to the patient. This stockinette then becomes with lining of the splint or cast.

While the application of the compression stocking alleviates the discomfort of the patient in the long run, the patient experiences pain during the application procedure of the compression stocking. Particularly, the patient may experience pain and discomfort while the health care worker positions the tight-fitting stocking on the injured limb.

Thus, there is a need for an applicator that facilitates the deployment of the compression stocking on the injured limb of the patient, while reducing the discomfort for the patient. Additionally, there is a need for an applicator that prevents further movement of the injured or post surgical bone or joint.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

The present disclosure is directed towards a stocking application device to facilitate an application of a stocking over a limb of a person. An operator or a healthcare worker may use the stocking application device to apply the stocking over the limb of the person, causing minimal discomfort, pain or change of position to the person.

Examples of the stocking may include a sown or elastic sock, a compression stocking, splint or cast liner, or a bandage. The person to whom the operator applies the stocking may include, for example, a patient with an operative wound or a broken bone, an elderly person or a child.

The stocking application device may include a first body portion and a second body portion. In some aspects, the first body portion may be positioned at a proximate end of the stocking application device. The first body portion may include a grip handle and an elongated member, forming a unitary continuous structure.

In one or more embodiments, the grip handle and/or the elongated member may allow the operator to firmly grip or hold the stocking application device.

In one or more embodiments, the elongated member may be fastened to the second body portion of the stocking application device. In some aspects, the second body portion may include U-shaped fingers that form an internal cavity into which the operator inserts the limb of the person.

In one or more embodiments, the operator may slide the stocking over the grip handle, the elongated member and the U-shaped fingers, when the limb of the person is fully inside the internal cavity formed by the U-shaped fingers. To apply the stocking over the limb, the operator may "pull" the handle grip and/or the elongated member gently, and consequently pull the stocking application device, to slowly place the stocking over the limb.

Illustrative Embodiments

The disclosure will be described more fully hereinafter with reference to the accompanying drawings, in which example embodiments of the disclosure are shown, and not intended to be limiting.

Figure 1:
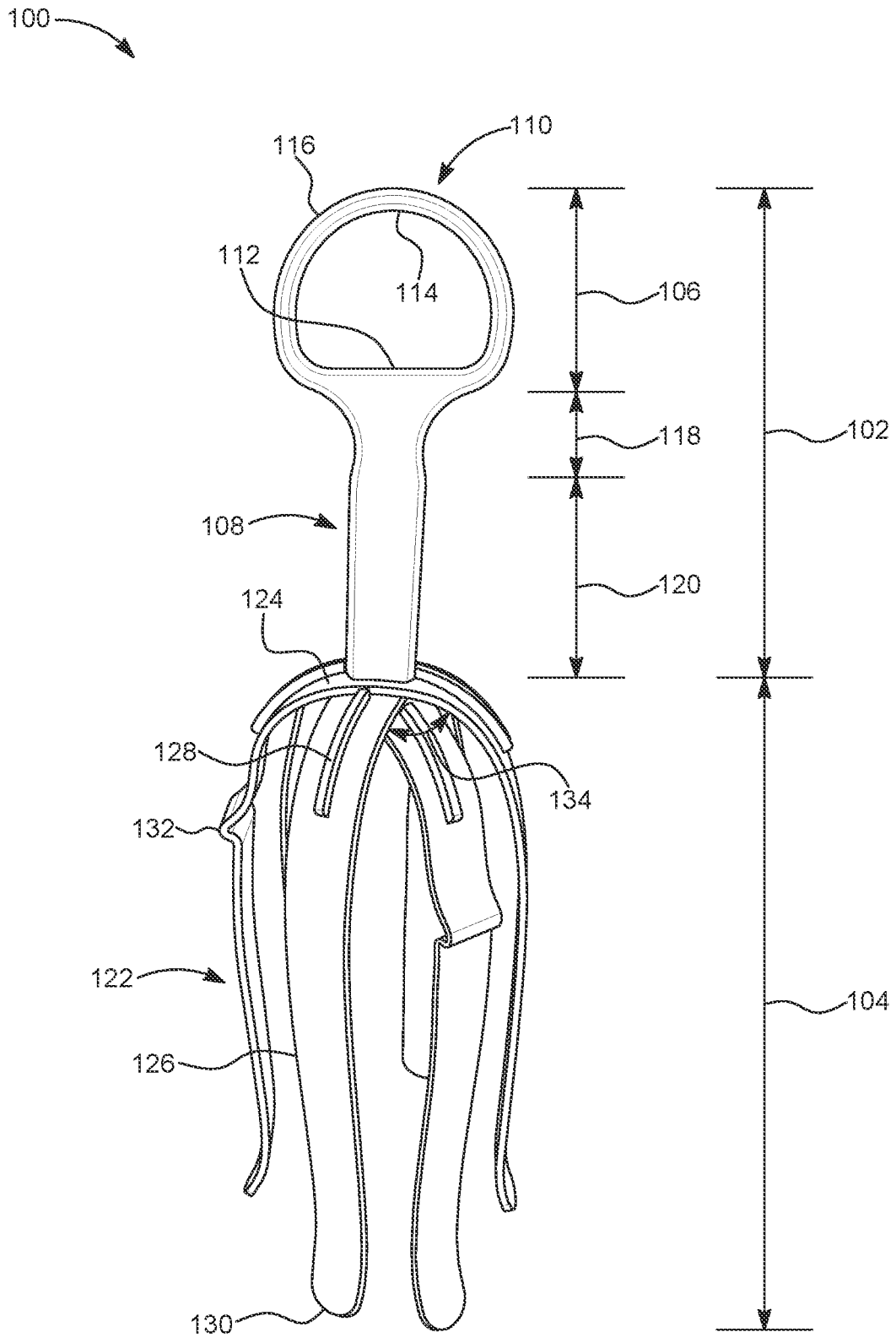
FIG. 1 depicts a first view of an example stocking application device in accordance with the present disclosure.

FIG. 1 depicts a first view of an example stocking application device 100 in accordance with the present disclosure. An operator or a healthcare worker may use the stocking application device 100 to place a stocking over a limb of a person, causing minimal discomfort or pain to the person. The stocking may include, for example, a sown or elastic sock, a compression stocking, splint or cast liner, or a bandage. The person to whom the operator applies the stocking may include, for example, a patient with an operative wound or a broken bone, an elderly person or a child.

The stocking application device 100 may include a first body portion 102 and a second body portion 104. In accordance with an embodiment of the present disclosure, the first body portion 102 is at a proximate end of the stocking application device 100, and the second body portion 104 is at a distal end of the stocking application device 100. In some aspects, the first body portion 102 and the second body portion 104 are attached to each other by using a fastening means. The fastening means may include one or more of fasteners, rivets, pins, adhesives, or any other sealing means.

In accordance with an embodiment of the present disclosure, the first body portion 102 may include a handheld portion which allows the operator of the stocking application device 100 to grip or hold the stocking application device 100 firmly. The handheld portion may include, for example, a grip handle 106 and an elongated member 108. The grip handle 106 may be located at a proximate end of the handheld portion, and the elongated member 108 may be located at a distal end of the handheld portion. In some aspects, the grip handle 106 and the elongated member 108 form a unitary continuous structure of the handheld portion. In additional embodiments, the grip handle 106 and the elongated member 108 may be attached to each other by using a fastener (not shown in FIG. 1).

In accordance with an embodiment of the present disclosure, the grip handle 106 may include one of a square-ended u-shaped loop hand hold, a circular loop hand hold, a rectangular loop hand hold, a triangular loop hand hold, or any other shaped loop hand hold. A person ordinary skilled in the art may appreciate that the grip handle 106 may be of any shape that facilitates the operator of the stocking application device 100 to hold the stocking application device 100 firmly. In accordance with an embodiment of the present disclosure, the grip handle 106 may be made of one or more of plastic, stainless steel, metal, silicon, and the like.

In one or more embodiments, the grip handle 106 may include a top end 110, and a bottom end 112 as shown in FIG. 1. In some aspects, the top end 110 may be curved and the bottom end 112 may be straight. Alternatively, the top end 110 may be U-shaped, triangular, semi-circular, or any other shape. Similarly, the bottom end 112 may be curved, semi-circular, or any other shape.

The top end 110 of the grip handle 106 may have an interior surface 114 and an exterior surface 116. In accordance with an embodiment of the present disclosure, the interior surface 114 of the top end 110 may include a plurality of indents (not shown in FIG. 1) of fingers, to facilitate the operator of the stocking application device 100 to grip the device comfortably. Alternatively, the interior surface 114 of the top end 110 may include any other structure that facilitates the operator to grip the stocking application device 100 firmly. In some aspects, the exterior surface 116 of the top end 110 may be a flat surface or may be include a cushion to enable convenient grip of the grip handle 106.

In accordance with an embodiment of the present disclosure, the elongated member 108 may include one or more curved portions 118. Along with the grip handle 106 as described above, the curved portions 118 assist the operator of the stocking application device 100 to hold the device comfortably and without slippage.

In accordance with further embodiments of the present disclosure, the elongated member 108 may include one or more straight portions 120. In some aspects, the length of the one or more straight portions 120 is greater than the length of the one or more curved portions 118. Alternatively, the length of the one or more straight portions 120 may be equal or less than the length of the one or more curved portions 118. In addition, the one or more curved portions 118 may be located closer to the grip handle 106, and the one or more straight portions 120 may be located closer to the second body portion 104.

In accordance with an embodiment of the present disclosure, the elongated member 108 of the handheld portion may attach with the second body portion 104. In particular, the elongated member 108 and the second body portion 104 may attached to each other by using a fastening means (not shown in FIG. 1). The fastening means may include one or more of fasteners, rivets, pins, adhesives, or any other sealing means.

Figure 3:
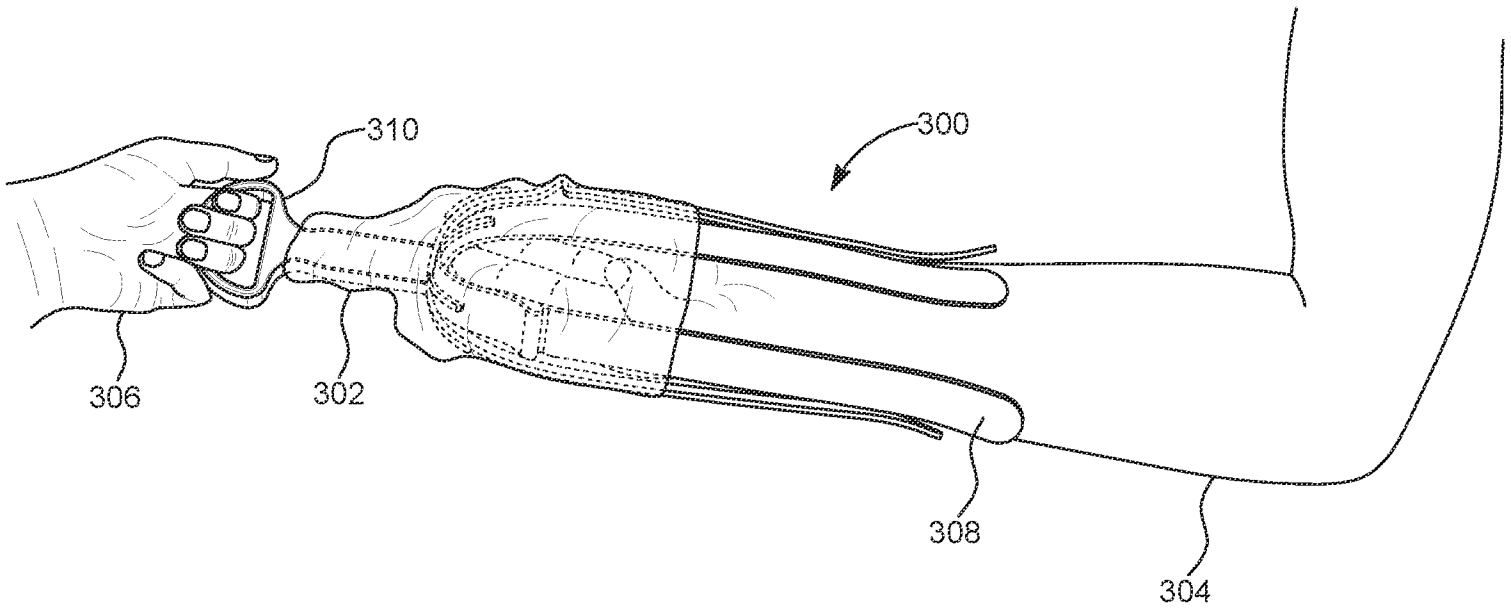
FIG. 3 depicts a perspective view of the example stocking application device during an application of a stocking on a limb of a person, in accordance with the present disclosure.
Figure 4:
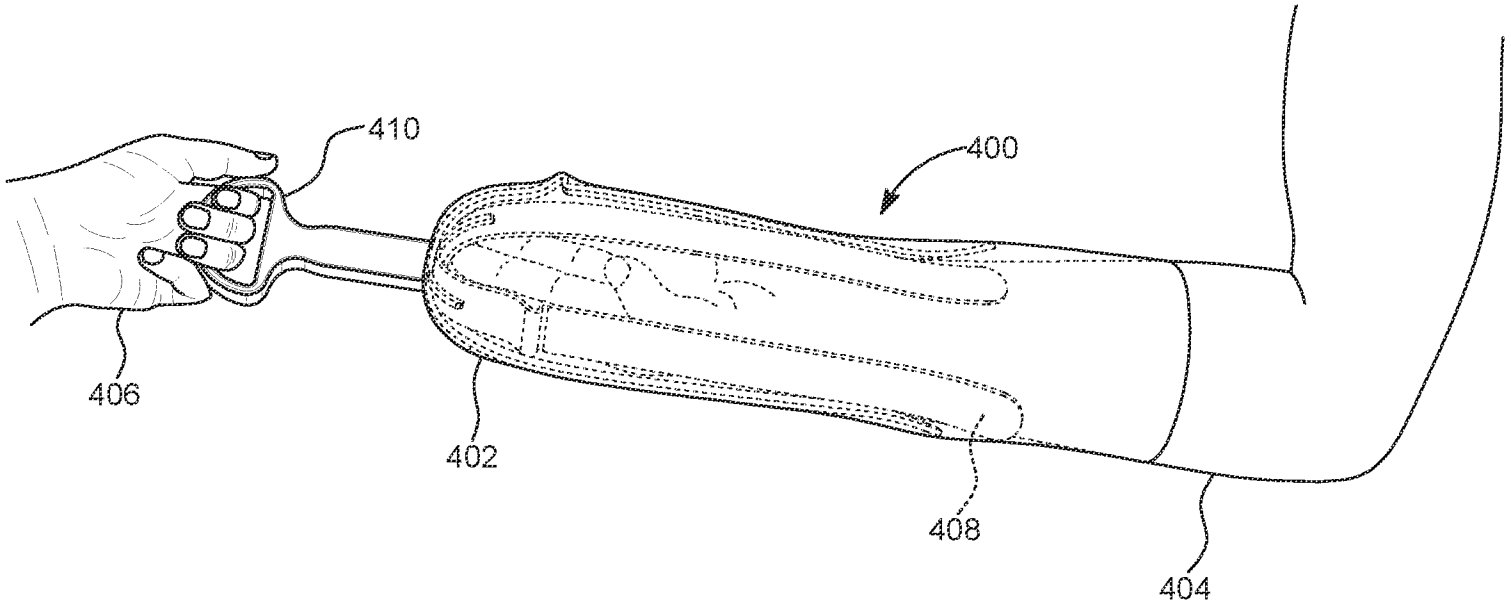
FIG. 4 depicts another perspective view of the example stocking application device when the stocking is completely stretched and deployed on the limb of the person, in accordance with the present disclosure.

In accordance with an embodiment of the present disclosure, the second body portion 104 may include a plurality of fingers 122 that are adapted to create an internal cavity to allow the limb of the person to pass through during the application of the stocking (as shown and described in conjunction with FIGS. 3 and 4). In some aspects, the plurality of fingers 122 are U-shaped fingers, as shown in FIG. 1.

Each of the plurality of fingers 122 may include a horizontal portion 124, and a pair of vertical portions 126. In one or more embodiments, as shown in FIG. 1, the horizontal portions 124 of the plurality of fingers 122 may be curved and may include one or more elongated linear structures 128 on curved portion to provide rigidity to the structure and for aesthetic purposes. In an alternative embodiment not shown in FIG. 1, the side curves are plain and do not include the elongated linear structures 128.

Furthermore, in some aspects, the horizontal portions 124 of the plurality of fingers 122 may be disposed one over another as shown in FIG. 1. In particular, the horizontal portions 124 may be disposed one over another at a predetermined angle 134 such that vertical portions 126 of the plurality of fingers 122 are equally spaced from each other. In addition, the above-mentioned structure provides rigidity and facilitates in creating the internal cavity to allow the limb of the person to pass through.

In some aspects, the horizontal portions 124 are attached to each other, and are attached to the elongated member 108 by using the fastening means, as described above.

In accordance with further embodiment of the present disclosure, the pair of vertical portions 126 may have flared ends 130 as shown in FIG. 1. The flared ends 130 of the pair of vertical portions 126 are adapted to form a flared entrance into the internal cavity at the distal end of the stocking application device 100. In one or more embodiments, the flared ends 130 may be titled slightly (For example, at an angle of 0 to 20 degree) outwards from the plane of the vertical portions 126, as shown in FIG. 1. In another embodiment, the angle of the tilt of the flared ends 130 may be greater than the embodiment shown in FIG. 1.

Additionally, in some aspects, each of the pair of vertical portions 126 may have a curved S-shaped structure as shown in FIG. 1. This specific structure allows the diameter of the internal cavity at the proximate end of the second body portion 104 to be slightly greater than the diameter of the internal cavity at the distal end of the second body portion 104. This structure facilities the operator (such as healthcare worker) of the stocking application device 100 to insert the limb of the person easily, specifically if the limb is the arm of the person (as the diameter of the first is greater than the diameter of arm).

In accordance with an alternative embodiment of the present disclosure, each of the pair of vertical portions 126 may be straight, without any S-shaped curves or flared ends.

In accordance with further embodiment of the present disclosure, one vertical portion of the pair of vertical portions 126 may include a stocking grip surface 132. The stocking grip surface 132 facilitates the grip or hold of the stocking over the plurality of fingers 122. As shown in FIG. 1, every alternate vertical portion may include the stocking grip surface 132.

In one or more embodiments, the stocking grip surface 132 may include a raised ridge or a hook structure to prevent slippage of the stocking, during the application of the stocking by using the stocking application device 100 (as shown and described in conjunction with FIGS. 3 and 4). In some aspects, the stocking grip surface 132 may be located distal to the horizontal portions 124 of the plurality of fingers 122. In another aspects, the stocking grip surface 132 may be located near to the middle of the vertical portion.

In accordance with an alternative embodiment of the present disclosure, each of the pair of vertical portions 126 may include the stocking grip surface 132 (not shown in FIG. 1).

In some aspects, the stocking grip surface 132 may be located at a same position in each of the pair of vertical portions 126. Alternatively, the stocking grip surface 132 may be located at different positions in different vertical portions (for example, some closer to the horizontal portions 124 and some at the middle of the vertical portions 126).

In some aspects, the plurality of fingers 122 may be even in number. For instance, the FIG. 1 shows three pairs of vertical fingers (six fingers on total) that are disposed over one another and are attached to the elongated member 108 by using the fastening means, as described above.

In accordance with further embodiment of the present disclosure, the height of the handheld portion (part of the first body portion 102) may be less than the height of the plurality of fingers 122 (part of the second body portion 104). Alternatively, the height of the handheld portion may be greater than the height of the plurality of fingers 122. In some aspects, the height of the plurality of fingers 122 and the height of the handheld portion may be same or equivalent.

In accordance with an embodiment of the present disclosure, the handheld portion may be made of one or more of plastic, stainless steel, metal, and silicon. In addition, the plurality of fingers 122 may be made of one or more of plastic, stainless steel or another metal or metallic alloy, and silicon. In some aspects, the handheld portion and the plurality of fingers 122 may be made of same material. In other aspects, the held portion and the plurality of fingers 122 may be made of different material.

Although FIG. 1 shows the first body portion 102 to include only the handheld portion containing the grip handle 106 and the elongated member 108, in one or more additional embodiments, the first body portion 102 may include additional members as well. For example, the first body portion 102 may additionally include aesthetic members (not shown in FIG. 1). In another example, the grip handle 106 and/or the elongated member 108 may include the aesthetic members. The first body portion 102 may include the additional aesthetic member when, for example, the stocking application device 100 is used in pediatric centers and/or used for kids.

Figure 2:
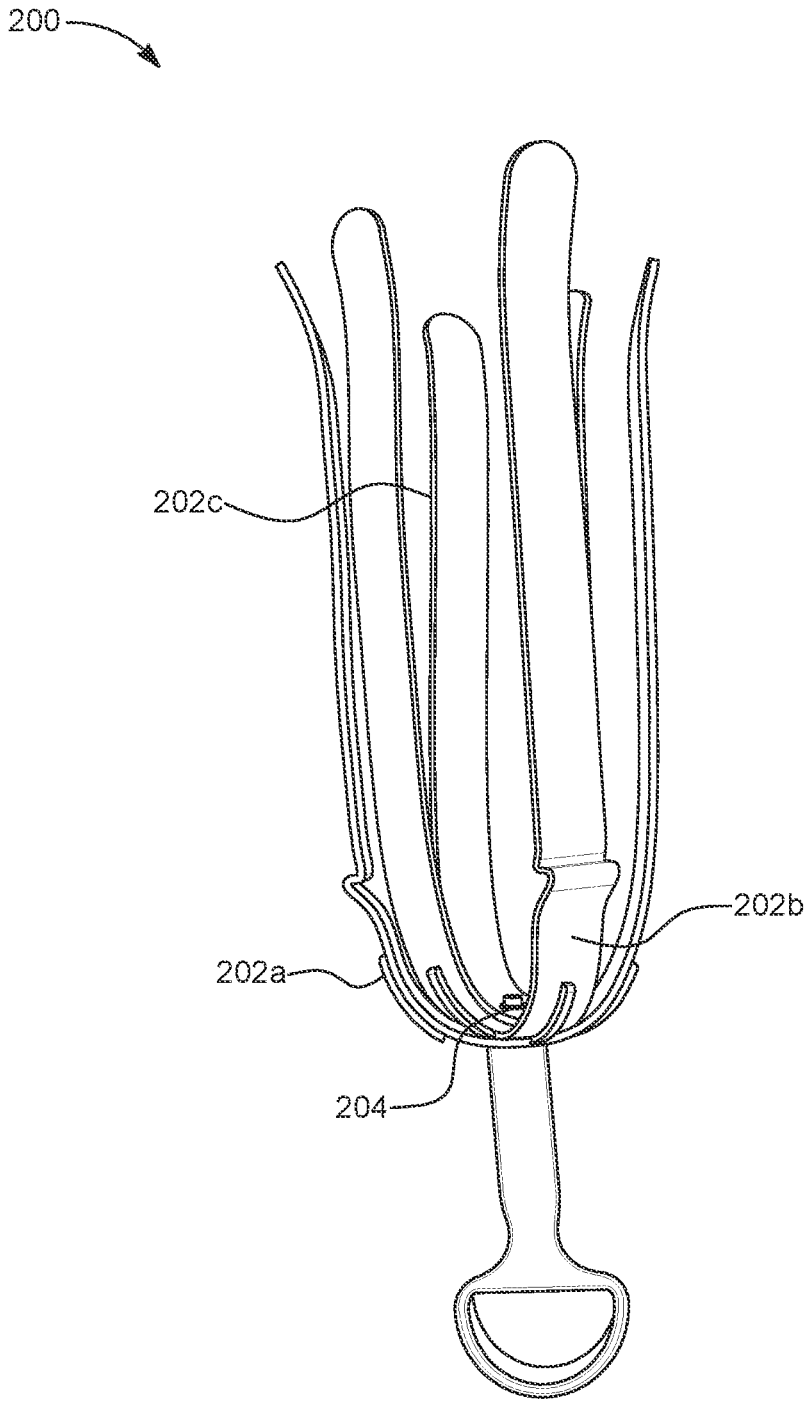
FIG. 2 depicts a second view of the example stocking application device in accordance with the present disclosure.

FIG. 2 depicts a second view (upside-down view) of an example stocking application device 200 (same as the stocking application device 100) in accordance with the present disclosure. As depicted in FIG. 2, the stocking application device 200 may include a plurality of U-shaped fingers 202*a*, 202*b*, and 202*c* (collectively considered as plurality of U-shaped fingers 202). As mentioned above in conjunction with FIG. 1, each of the plurality of U-shaped fingers 202 may include a horizontal portion and a pair of vertical portions.

As discussed above, the horizontal portions of the plurality of U-shaped fingers 202 are disposed over one another and are attached to the handheld portion using a fastening means 204. The fastening means 204 may include one or more of fasteners, rivets, pins, adhesives, or any other sealing means.

In an exemplary embodiment of the present disclosure, the U-shaped finger 202*a* may be the outermost U-shaped finger and the U-shaped finger 202*b* may be the middle finger that is disposed over the U-shaped finger 202*a* at a predetermined angle. Similarly, the U-shaped finger 202*c* may be the innermost U-shaped finger that is disposed on the U-shaped finger 202*b* at the predetermined angle. As already explained in conjunction with FIG. 1, the U-shaped fingers 202 are disposed at a predetermined angle from each other such that the vertical portions of the U-shaped fingers 202 are equally spaced.

FIG. 3 depicts a perspective view of an example stocking application device 300 (same as the stocking application device 100 or 200) during an application of a stocking 302 on a limb 304 of a person, in accordance with the present disclosure. The limb 304 may include, for example, an arm, a hand, a leg, or any other similar body part.

As discussed above in conjunction with FIGS. 1 and 2, the stocking application device 300 may include a plurality of U-shaped fingers 308 that form an internal cavity to allow insertion of the limb 304 into the stocking application device 300. In accordance with an embodiment of the present disclosure, in order to deploy the stocking 302 on the limb 304, an operator 306 (such as healthcare worker, the person himself, or any other operator) may insert the limb 304 inside the stocking application device 300 via the internal cavity that is formed by the plurality of U-shaped fingers 308.

Additionally, the operator 306 may dispose the stocking 302 over the stocking application device 300. In some aspects, the operator 306 may dispose the stocking 302 from a grip handle 310 of the stocking application device 300 and may gently stretch the stocking 302 to cover the entire length of the stocking application device 300. Due to the structure of the stocking application device 300, the operator 306 may easily stretch the stocking 302, without any slippage of the stocking 302. Specifically, a stocking grip surface (for example, a raised ridge as explained in conjunction with FIG. 1) of the stocking application device 300 ensures that the stocking 302 does not slip, when the operator 306 stretches the stocking 302 from the grip handle 310 towards the end of the stocking application device 300.

By using the stocking application device 300, the person does not feel much discomfort or pain during the application of the stocking 302. This is because the stocking 302 does not appreciably (or completely) "press" the limb 304 while the stocking 302 is stretched by the operator 306. As discussed in conjunction with FIG. 4, the stocking 302 presses the limb 304 tightly only when the stocking 302 is completely stretched by the operator 306 and when the stocking application device 300 is gently "pulled" by the operator 306 off the limb 304 of the person.

FIG. 4 depicts another perspective view of an example stocking application device 400 (same as stocking application device 300) when a stocking 402 (same as the stocking 302) is completely stretched and deployed on a limb 404 (same as the limb 304) of a person, in accordance with the present disclosure. When the stocking 402 is completely stretched over a plurality of U-shaped fingers 408 and deployed on the limb 404 as shown in FIG. 4, the operator 406 "pulls" the stocking application device 400 such that the stocking 402 covers the skin of the limb 404 in a tight manner. Specifically, the operator 406 gently pulls the stocking application device 400 in such a manner that the stocking application device 400 slides between the stocking 402 and limb 404, leaving the stocking 402 behind to cover the limb 404 directly. In other words, the stocking 402 is disposed on the limb 404 as the operator 406 pulls the stocking application device 400.

In order to pull the stocking application device 400, the operator 406 may put his fingers in the grip handle 410 and may pull the stocking application device 400 towards the device user.

A person ordinarily skilled in the art may appreciate that when the stocking 402 is applied to the limb 404, the operator 406 may apply the cast material on the stocking 402 to facilitate recovery of bones and tissues of the limb 404.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A stocking application device to facilitate an application of a stocking over a limb of a person, the stocking application device comprising:

a first body portion at a proximate end of the stocking application device, wherein the first body portion comprises a handheld portion, and wherein the handheld portion comprises a grip handle and an elongated member forming a unitary continuous structure of the handheld portion;

a second body portion attached to the first body portion, wherein the second body portion comprises a plurality of U-shaped fingers adapted to create an internal cavity to allow the limb of the person to pass through during the application of the stocking, wherein:

each of the plurality of U-shaped fingers comprises a horizontal portion and a pair of vertical portions, each vertical portion of the pair of vertical portions comprises a flared end, wherein flared ends of the pair of vertical portions of the plurality of U-shaped fingers are adapted to form a flared entrance into the internal cavity at a distal end of the stocking application device, wherein horizontal portions of the plurality of U-shaped fingers are disposed one over another and attached to the first body portion, and wherein the horizontal portions are disposed one over another at a predetermined angle such that vertical portions of the plurality of U-shaped fingers are equally spaced from each other.

2. The stocking application device of claim 1, wherein each vertical portion of the pair of vertical portions comprises a stocking grip surface, located proximate to the horizontal portion, to hold the stocking over the stocking application device.

3. The stocking application device of claim 1, wherein one vertical portion of the pair of vertical portions comprises a stocking grip surface, located proximate to the horizontal portion, to hold the stocking over the stocking application device.

4. The stocking application device of claim 3, wherein the stocking grip surface comprises a raised ridge.

5. The stocking application device of claim 1, wherein the grip handle is located at a proximate end of the handheld portion.

6. The stocking application device of claim 1, wherein the grip handle is one of a square-ended u-shaped loop hand hold and a circular loop hand hold.

7. The stocking application device of claim 1, wherein the grip handle comprises a top end and a bottom end, and wherein the top end further comprises an interior surface and an exterior surface.

8. The stocking application device of claim 7, wherein the interior surface of the top end of the grip handle comprises a plurality of indents, and wherein the exterior surface of the top end and the bottom end of the grip handle are flat.

9. The stocking application device of claim 1, wherein the elongated member is attached to the horizontal portions of the plurality of U-shaped fingers.

10. The stocking application device of claim 9, wherein the elongated member is attached to the horizontal portions of the plurality of U-shaped fingers by a fastener.

11. The stocking application device of claim 1, wherein the elongated member comprises one or more curved side portions.

12. The stocking application device of claim 1, wherein the elongated member comprises one or more flat side portions.

13. The stocking application device of claim 1, wherein the handheld portion is made of one or more of plastic, stainless steel, metal, and silicon.

14. The stocking application device of claim 1, wherein the plurality of U-shaped fingers are made of one or more of plastic, stainless steel, metal, and silicon.

15. The stocking application device of claim 1, wherein the handheld portion and the plurality of U-shaped fingers are made of different materials.

16. The stocking application device of claim 1, wherein the handheld portion and the plurality of U-shaped fingers are made of same material.

17. The stocking application device of claim 1, wherein the stocking comprises one of a sock, a compression stocking, and a bandage.

18. A stocking application device to facilitate an application of a stocking over a limb of a person, the stocking application device comprising:

a first body portion at a proximate end of the stocking application device, wherein the first body portion comprises a handheld portion, and wherein the handheld portion comprises a grip handle and an elongated member forming a unitary continuous structure of the handheld portion;

a second body portion attached to the first body portion, wherein the second body portion comprises a plurality of U-shaped fingers adapted to create an internal cavity to allow the limb of the person to pass through during the application of the stocking, wherein:

each of the plurality of U-shaped fingers comprises a horizontal portion and a pair of vertical portions, each vertical portion of the pair of vertical portions comprises a flared end, wherein flared ends of the pair of vertical portions of the plurality of U-shaped fingers are adapted to form a flared entrance into the internal cavity at a distal end of the stocking application device, wherein horizontal portions of the plurality of U-shaped fingers are disposed one over another and attached to the first body portion, wherein the horizontal portions are disposed one over another at a predetermined angle such that vertical portions of the plurality of U-shaped fingers are equally spaced from each other, and wherein each vertical portion of the pair of vertical portions comprises a stocking grip surface, located proximate to the horizontal portion, to hold the stocking over the stocking application device.

19. A method for applying a stocking over a limb comprising:

grasping a handheld portion disposed at a proximate of a first body portion of a stocking application device, and wherein the handheld portion comprises a grip handle and an elongated member forming a unitary continuous structure of the handheld portion;

fitting the stocking on a second body portion attached to the first body portion, wherein the second body portion comprises a plurality of U-shaped fingers adapted to create an internal cavity to allow the limb to pass through during the application of the stocking, wherein:

each of the plurality of U-shaped fingers comprises a horizontal portion and a pair of vertical portions, each vertical portion of the pair of vertical portions comprises a flared end, wherein flared ends of the pair of vertical portions of the plurality of U-shaped fingers are adapted to form a flared entrance into the internal cavity at a distal end of the stocking application device, wherein horizontal portions of the plurality of U-shaped fingers are disposed one over another and attached to the first body portion, and wherein the horizontal portions are disposed one over another at a predetermined angle such that vertical portions of the plurality of U-shaped fingers are equally spaced from each other;

positioning limb in an interior portion of the internal cavity; and gripping the stocking end by holding the stocking in position with respect to the limb while simultaneously sliding stocking application device such that the stocking disengages from the stocking application device and onto the limb.

* * * * *